US009812041B2

(12) United States Patent
Hatano

(10) Patent No.: US 9,812,041 B2
(45) Date of Patent: Nov. 7, 2017

(54) DISPLAY DEVICE MANUFACTURING METHOD

(71) Applicant: NICHIA CORPORATION, Anan-shi, Tokushima (JP)

(72) Inventor: Tomohiko Hatano, Tokushima (JP)

(73) Assignee: NICHIA CORPORATION, Anan-Shi (JP)

( * ) Notice: Subject to any disclaimer, the term of this patent is extended or adjusted under 35 U.S.C. 154(b) by 219 days.

(21) Appl. No.: 14/490,019

(22) Filed: Sep. 18, 2014

(65) Prior Publication Data

US 2015/0082610 A1 Mar. 26, 2015

(30) Foreign Application Priority Data

Sep. 20, 2013 (JP) ..... 2013-196245

(51) Int. Cl.
*F21V 17/12* (2006.01)
*F21V 17/04* (2006.01)
*G09F 9/33* (2006.01)

(52) U.S. Cl.
CPC ..... *G09F 9/33* (2013.01); *Y10T 29/49963* (2015.01)

(58) Field of Classification Search
CPC ..... G02F 1/133509; G02F 1/133516; G02B 5/003; Y10T 29/49869; Y10T 29/49963; Y10T 29/49881
See application file for complete search history.

(56) References Cited

U.S. PATENT DOCUMENTS 3,517,109 A * 6/1970 Young ..... H05K 9/0073 174/373
3,885,150 A * 5/1975 Ott ..... F21V 11/06 174/382
4,439,968 A * 4/1984 Dunn ..... B64G 1/58 244/159.1
4,788,577 A * 11/1988 Akiyama ..... G03F 7/70691 355/53
4,945,349 A * 7/1990 Sanai ..... G02F 1/133509 349/104

(Continued)

FOREIGN PATENT DOCUMENTS

JP 08160885 A * 6/1996
JP 08185130 A * 7/1996

(Continued)

OTHER PUBLICATIONS

IBM Technical Disclosure Bulletin, vol. 19, Issue No. 4. Published Sep. 1976.*

*Primary Examiner* — John C Hong
(74) *Attorney, Agent, or Firm* — Squire Patton Boggs (US) LLP

(57) ABSTRACT

A display device manufacturing method includes: preparing a substrate on which a plurality of light emitting elements are mounted; preparing a light shielding mask that is provided with a plurality of windows respectively transmitting light from the plurality of light emitting elements and that is warped so as to protrude towards an incident side of light from the plurality of light emitting elements; preparing a case in which a substrate is disposed; and screwing the light shielding mask to the case so that the light shielding mask is parallel or approximately parallel with respect to the substrate.

23 Claims, 13 Drawing Sheets

(56) References Cited

U.S. PATENT DOCUMENTS

| | | | | | |
|---|---|---|---|---|---|
| 5,090,857 | A * | 2/1992 | Dunn | F16B 33/006 | 411/354 |
| 6,055,029 | A * | 4/2000 | Kurihara | G02B 6/0088 | 349/58 |
| 6,536,913 | B1 * | 3/2003 | Yajima | G09F 9/33 | 362/231 |
| 8,876,160 | B2 * | 11/2014 | Olson | B62D 21/02 | 180/312 |
| 2011/0121554 | A1 * | 5/2011 | Olson | B62D 21/02 | 280/781 |
| 2014/0085885 | A1 * | 3/2014 | Hatano | G09F 27/008 | 362/235 |
| 2015/0082610 | A1 * | 3/2015 | Hatano | G09F 9/33 | 29/525.11 |
| 2016/0109748 | A1 * | 4/2016 | Kim | G02F 1/133512 | 359/893 |

FOREIGN PATENT DOCUMENTS

| | | | | |
|---|---|---|---|---|
| JP | 08-234684 | A | | 9/1996 |
| JP | 08234684 | A | * | 9/1996 |
| JP | 2000293116 | A | * | 10/2000 |
| JP | 2001-255835 | A | | 9/2001 |
| JP | 2009002979 | A | * | 1/2009 |
| JP | 2009-222897 | A | | 10/2009 |
| JP | 2011191454 | A | * | 9/2011 |

* cited by examiner

DISPLAY DEVICE MANUFACTURING METHOD

BACKGROUND

Field

The present disclosure relates to a display device manufacturing method.

Description of the Related Art

Conventionally, a display device is proposed for preventing visibility from being impaired when used in a bright place such as outdoors by screwing a light shielding louver (light shielding mask) made of a metal plate or the like to a front surface of a light emitting element to shield the light emitting element from direct sunlight (refer to the sections titled "Field of the Invention" and "Summary of the Invention" of Japanese Patent Application Laid-open No. H8-234684).

However, with the conventional display device described above, deflection of the light shielding louver (light shielding mask) which occurs when the light shielding louver (light shielding mask) is screwed may cause a deviation in a positional relationship between the light emitting element and the light shielding louver (light shielding mask). As a result, locations where a viewing angle of the display device becomes narrower may be partially generated and views provided by the display device may become uneven.

SUMMARY

In consideration thereof, an object of certain embodiments is to provide a manufacturing method of a display device capable of suppressing a deviation in a positional relationship caused by a deflection of a light shielding mask.

According to certain embodiments of the present invention, the problem presented above can be solved by a display device manufacturing method including preparing a substrate on which a plurality of light emitting elements are mounted, and preparing a light shielding mask that is provided with a plurality of windows respectively transmitting light from the plurality of light emitting elements, and that is warped so as to protrude towards an incident side of light from the plurality of light emitting elements. The method can include preparing a case in which a substrate is disposed and screws, and screwing the light shielding mask to the case so that the light shielding mask is parallel or approximately parallel with respect to the substrate.

According to certain embodiments, a viewing angle of the display device can be kept wide and an occurrence of unevenness in views provided by the display device can be suppressed.

BRIEF DESCRIPTION OF THE DRAWINGS

FIGS. 3A and 3B both correspond to a central part of an area surrounded by screwed locations, wherein FIG. 3A shows a case where the deflection of the light shielding mask is offset by warping and FIG. 3B shows a case where the deflection of the light shielding mask is not offset by warping.

FIG. 4A and FIG. 4B are schematic perspective views illustrating that certain embodiments are particularly effective when intervals among a plurality of light emitting elements are small, wherein FIG. 4A shows a case where the intervals are large and FIG. 4B shows a case where the intervals are small.

Each of FIG. 6A and FIG. 6B is a front view of a light shielding louver prior to being screwed to a substrate, wherein FIG. 6A is a front view of a light shielding louver used in the display device according to the first example and FIG. 6B is a front view of a light shielding louver used in the display device according to the comparative example.

DETAILED DESCRIPTION

Hereinafter, embodiments will be described with reference to the attached drawings.

FIGS. 1A to 1D are schematic perspective views illustrating a display device manufacturing method according to certain embodiments.

As shown in FIGS. 1A to 1D, a display device manufacturing method according to certain embodiments includes a step (first step) of preparing a substrate 20 on which a plurality of light emitting elements 30 are mounted. A second step can be preparing a light shielding mask 40 which is provided with a plurality of windows that respectively transmit light from the plurality of light emitting elements 30 and which is warped so as to protrude towards an incident side of light from the light emitting elements 30. A third step can be preparing a case 10 in which a substrate 20 is disposed. A fourth step can be screwing the light shielding mask 40 to the case 10 so that the light shielding mask 40 is parallel or approximately parallel with respect to the substrate 20.

Hereinafter, a step-by-step description will be given.

Figure 1A:
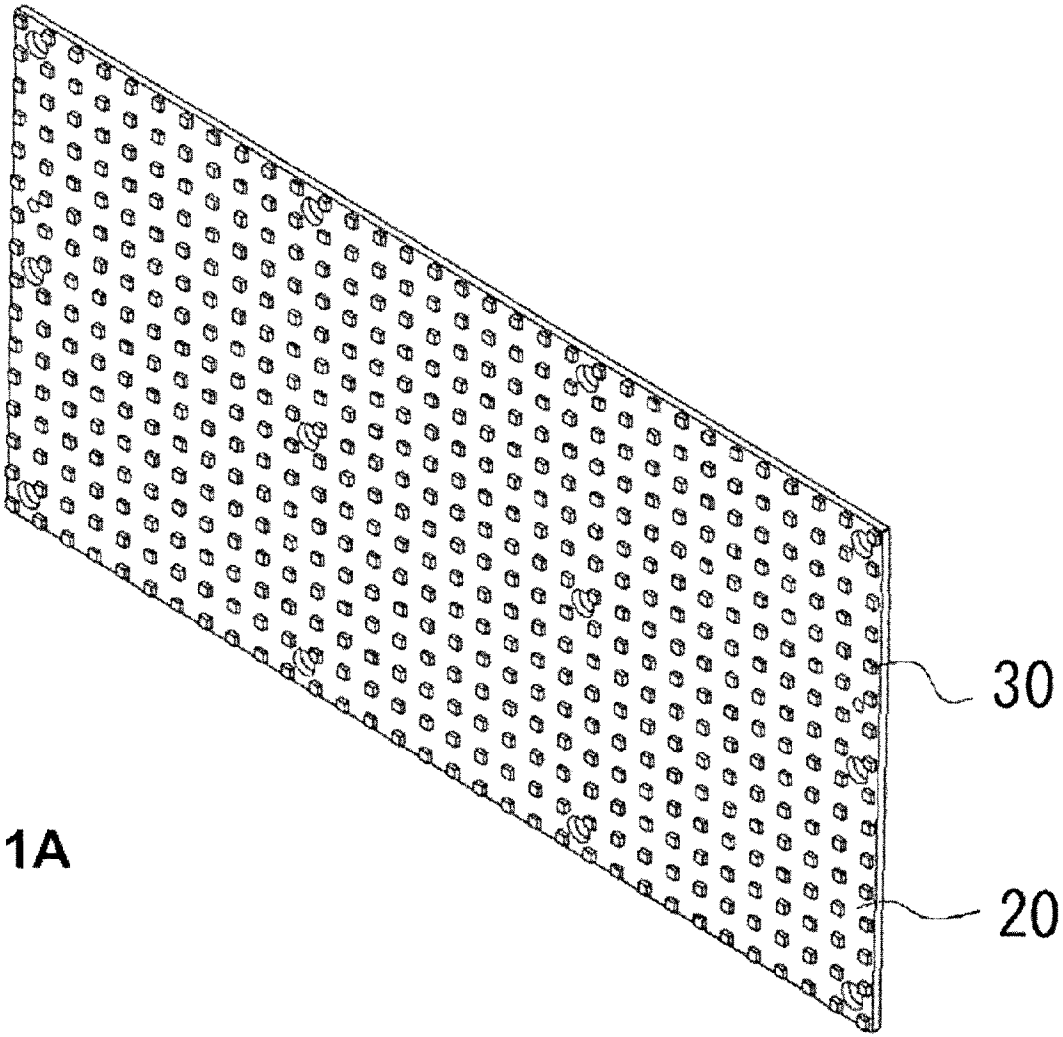
FIG. 1A is a schematic perspective view illustrating a display device manufacturing method according to certain embodiments.

First, as shown in FIG. 1A, a substrate 20 on which a plurality of light emitting elements 30 are mounted is prepared.

The substrate 20 has a substantially flat plate shape. A so-called rigid substrate such as a glass epoxy substrate and a glass composite substrate can be used as the substrate 20. Dimensions of the substrate 20 can be, for example, 50 to 150 mm in longitudinal length, 150 to 250 mm in transversal length, and 1.5 to 2.5 mm in thickness. Wiring can be formed on the substrate 20.

A surface-mounted light emitting diode (LED) or the like can be used as the light emitting element 30. Dimensions of the light emitting element 30 can be, for example, 1.5 to 2.5 mm in longitudinal length, 1.5 to 2.5 mm in transversal length, and 0.5 to 1.5 mm in thickness.

Figure 1B:
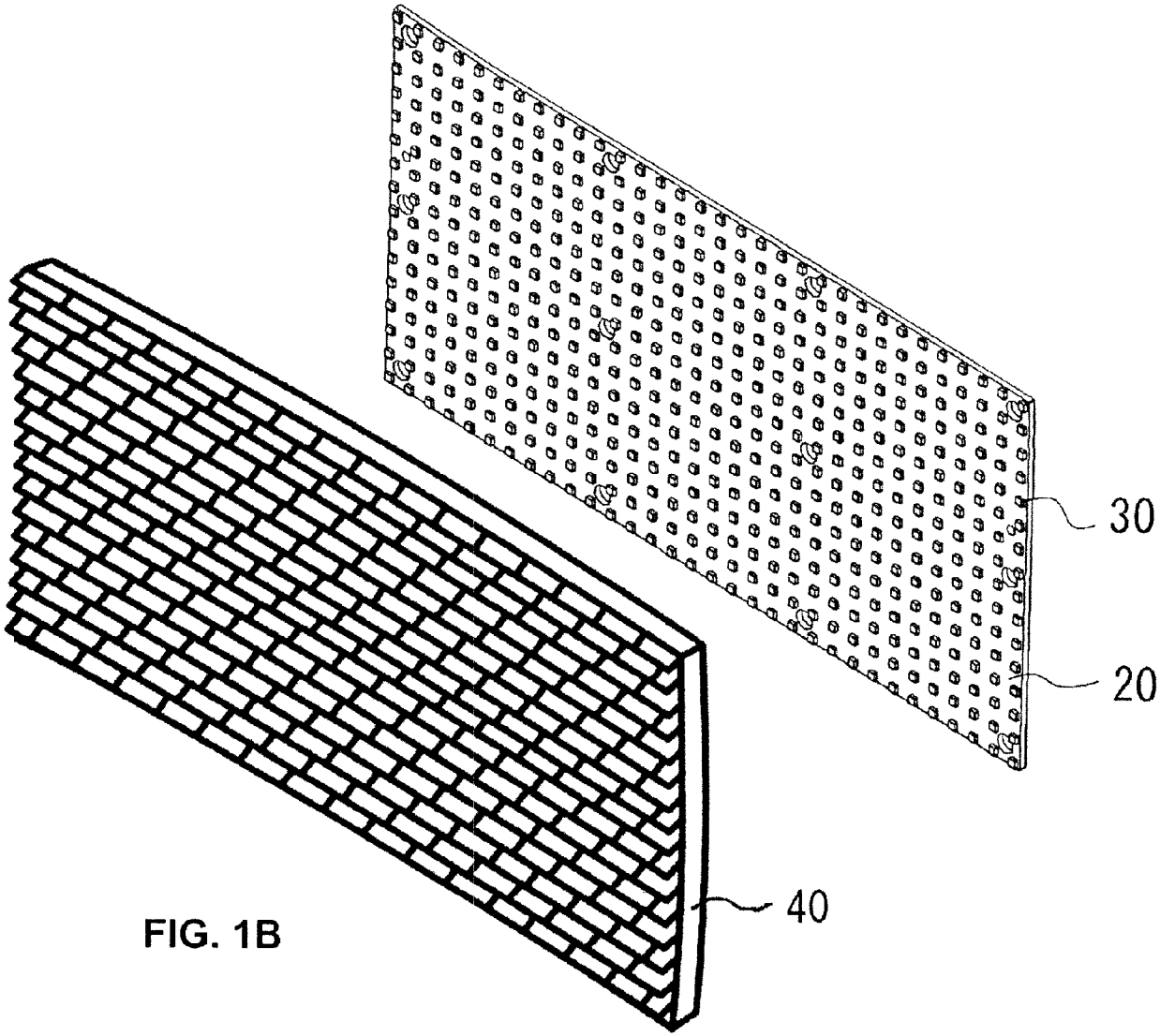
FIG. 1B is a schematic perspective view illustrating the display device manufacturing method according to certain embodiments.

Next, as shown in FIG. 1B, a light shielding mask 40 is prepared. The light shielding mask 40 is flexible.

The light shielding mask 40 is provided with a plurality of windows that respectively transmit light from the plurality of light emitting elements 30 and is warped so as to protrude towards an incident side (the side of the substrate 20) of light from the light emitting elements 30. For example, the plurality of windows can be provided in a matrix pattern. In addition, positions of the plurality of windows provided on the light shielding mask 40 are configured so as to ultimately correspond to positions of the light emitting elements 30 mounted on the substrate 20.

While a shape of the windows is not particularly limited, the windows can be typically shaped so as to correspond to a shape of a light emitting part of the light emitting element 30. Dimensions of the light shielding mask 40 can be, for example, 50 to 150 mm in longitudinal length and 150 to 250 mm in transversal length.

Figure 1C:
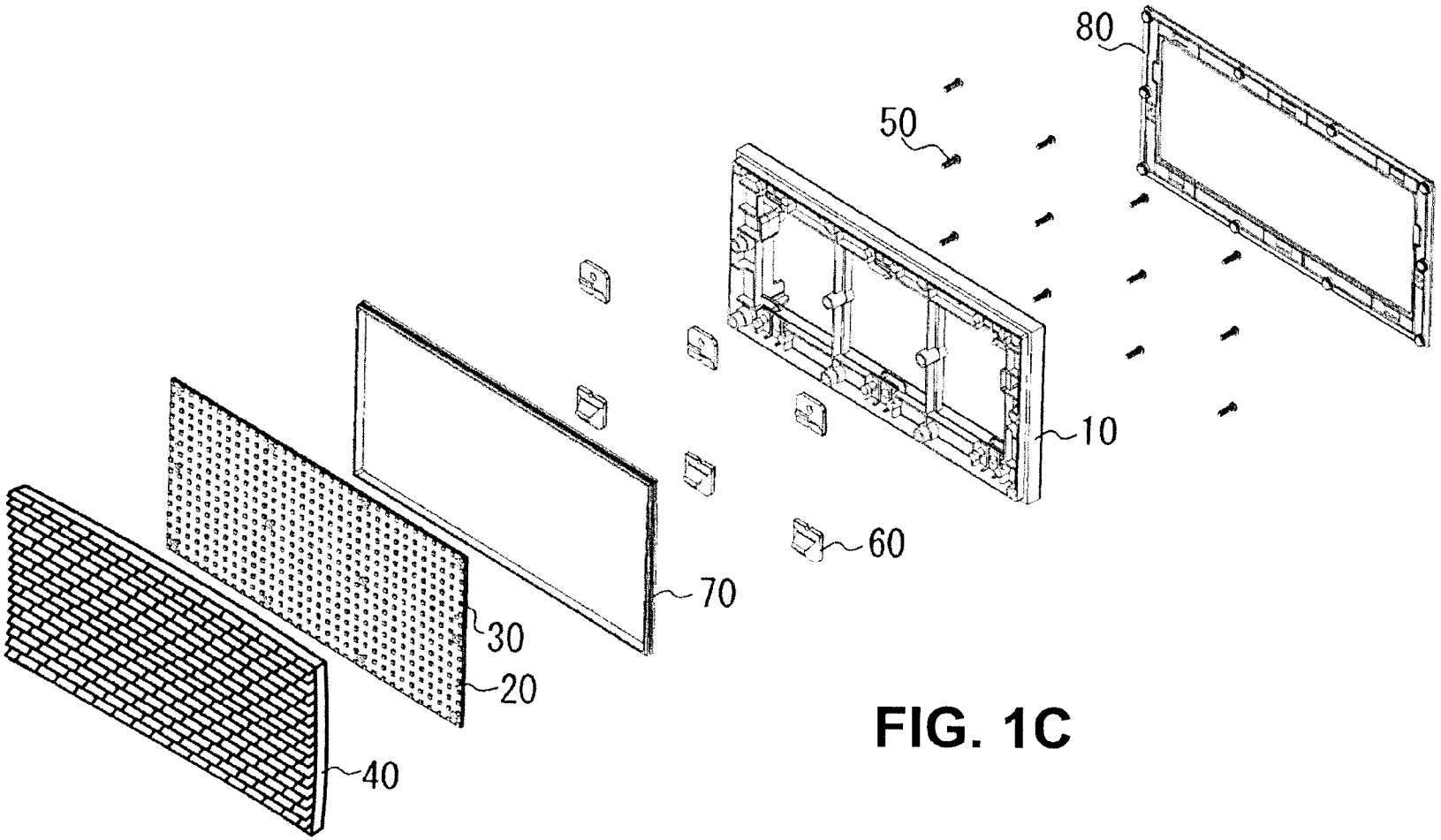
FIG. 1C is a schematic perspective view illustrating the display device manufacturing method according to certain embodiments.

Next, as shown in FIG. 1C, a case 10 in which the substrate 20 is disposed and screws 50 are prepared.

Polycarbonate resin, noryl resin, or the like can be used for the case 10. For example, the case 10 has a rectangular shape. In addition, iron screws, aluminum screws, or the like may be used as the screws 50. Furthermore, the number of screws 50 (the number of screwing locations) is not particularly limited. In some embodiments, the number of the screwing locations is 12, but this is just an example.

Six brackets 60 are disposed between the case 10 and the substrate 20. The brackets 60 are members for attaching the display device to the outside. In this embodiment, the screws 50 are inserted from a rear side, and then the display device can be fixed to something such as an exterior wall with the brackets 60. The substrate 20 can be fixed by being sandwiched between the case 10 and the light shielding mask 40 and the brackets 60 are fixed by being fitted to the case 10.

A first packing 70 can be interposed between the case 10 and the light shielding mask 40. Accordingly, rain water or the like can be prevented from penetrating between the case 10 and the light shielding mask 40. Furthermore, in the display device according to certain embodiments, a second packing 80 is provided on a rear surface of the case 10. Accordingly, when the display device is attached to an exterior wall or the like, rain water can be prevented from penetrating between the display device and the exterior wall.

Figure 1D:
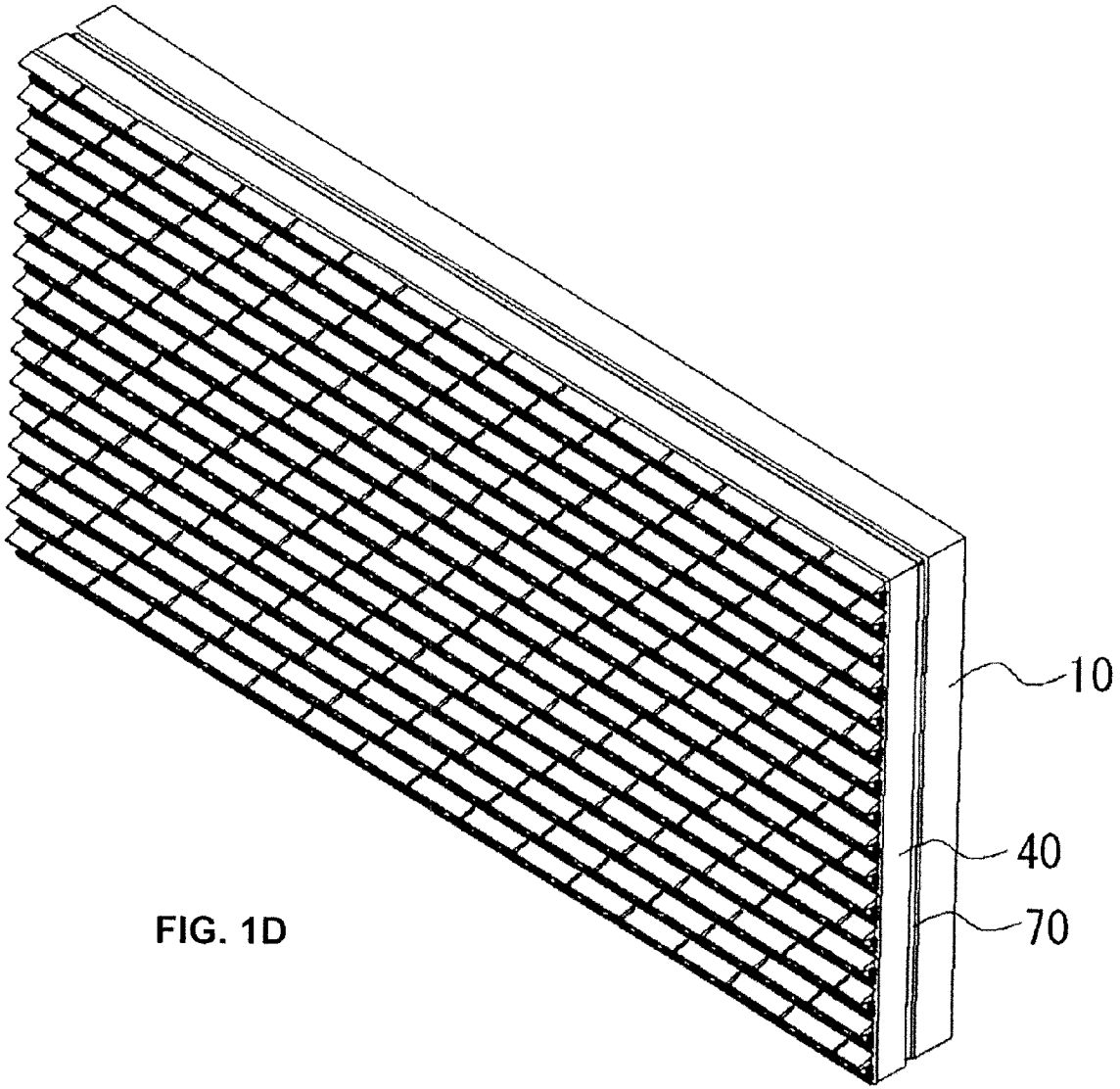
FIG. 1D is a schematic perspective view illustrating the display device manufacturing method according to certain embodiments.

Next, as shown in FIG. 1D, the light shielding mask 40 is screwed to the case 10 using the screws 50 so that the light shielding mask 40 is parallel or approximately parallel with respect to the substrate 20.

Specifically, since the light shielding mask 40 is flexible, when a screwed location is compressed due to the screwing and is subtly depressed, the light shielding mask 40 deforms so as to have a deflection in which an area surrounded by the screwed locations relatively protrudes toward a front surface (an observation surface). However, since warping that protrudes toward an incident side of light from the light emitting elements is formed in advance in the light shielding mask 40, the deflection generated by the screwing is offset (including cases where the deflection is approximately offset; the same description will apply hereinafter) by the warping formed in advance. Accordingly, the light shielding mask 40 as a whole becomes parallel or approximately parallel with respect to the substrate 20.

Moreover, as shown in FIG. 1C, a total of 3 (longitudinal)×4 (transversal)=12 screws 50 are used in certain embodiments. This means that there are a total of 2 (longitudinal)×3 (transversal)=6 areas where deflection occurs (areas surrounded by the screwed locations). On the other hand, the light shielding mask 40 is warped so that a center of the light shielding mask 40 protrudes toward the substrate 20 and is configured so as to form a curved surface from a center towards peripheral edges (for example, refer to FIG. 6A to be described later). In other words, in this case, instead of separately forming six protrusions on the light shielding mask 40, six protrusions are integrally formed so as to form one large protrusion. However, it is also possible that the six protrusions are formed separately.

The light shielding mask 40 (41, 42), when screwed, does not completely cover the substrate 20 and the light emitting elements 30 and a gap is formed between the substrate 20 on which the light emitting elements 30 are mounted and the light shielding mask 40 (41, 42) (refer to FIGS. 3 and 4 to be described later). However, when screwed, the light shielding mask 40 (41, 42) may completely cover the substrate 20 and the light emitting elements 30. In this case, a gap is not formed between the substrate 20 on which the light emitting elements 30 are mounted and the light shielding mask 40 (41, 42).

With the display device manufacturing method according to the embodiment described above, the deflection of the light shielding mask 40 is offset by warping. Therefore, a display device capable of suppressing a deviation in a positional relationship caused by the deflection of the light shielding mask 40 can be provided, a viewing angle of the display device can be kept wide, and an occurrence of unevenness in views provided by the display device can be suppressed.

Moreover, a deflection of the light shielding mask 40 occurs more easily when the light shielding mask 40 is tightly screwed to the case 10. However, as described above, since the display device manufacturing method according to the embodiment enables the deflection to be offset by warping, the light shielding mask 40 can be tightly screwed to the case 10. Therefore, with the display device manufacturing method according to the embodiment, water can be prevented from penetrating into the case 10 from a gap between the light shielding mask 40 and the case 10 and the display device can be made more watertight.

A sequence of executing the first step, the second step, and the third step may be changed as appropriate. In other words, for example, the first to third steps may be executed in a sequence of the second step, the first step, and the third step or in a sequence of the third step, the second step, and the first step.

Figure 2:
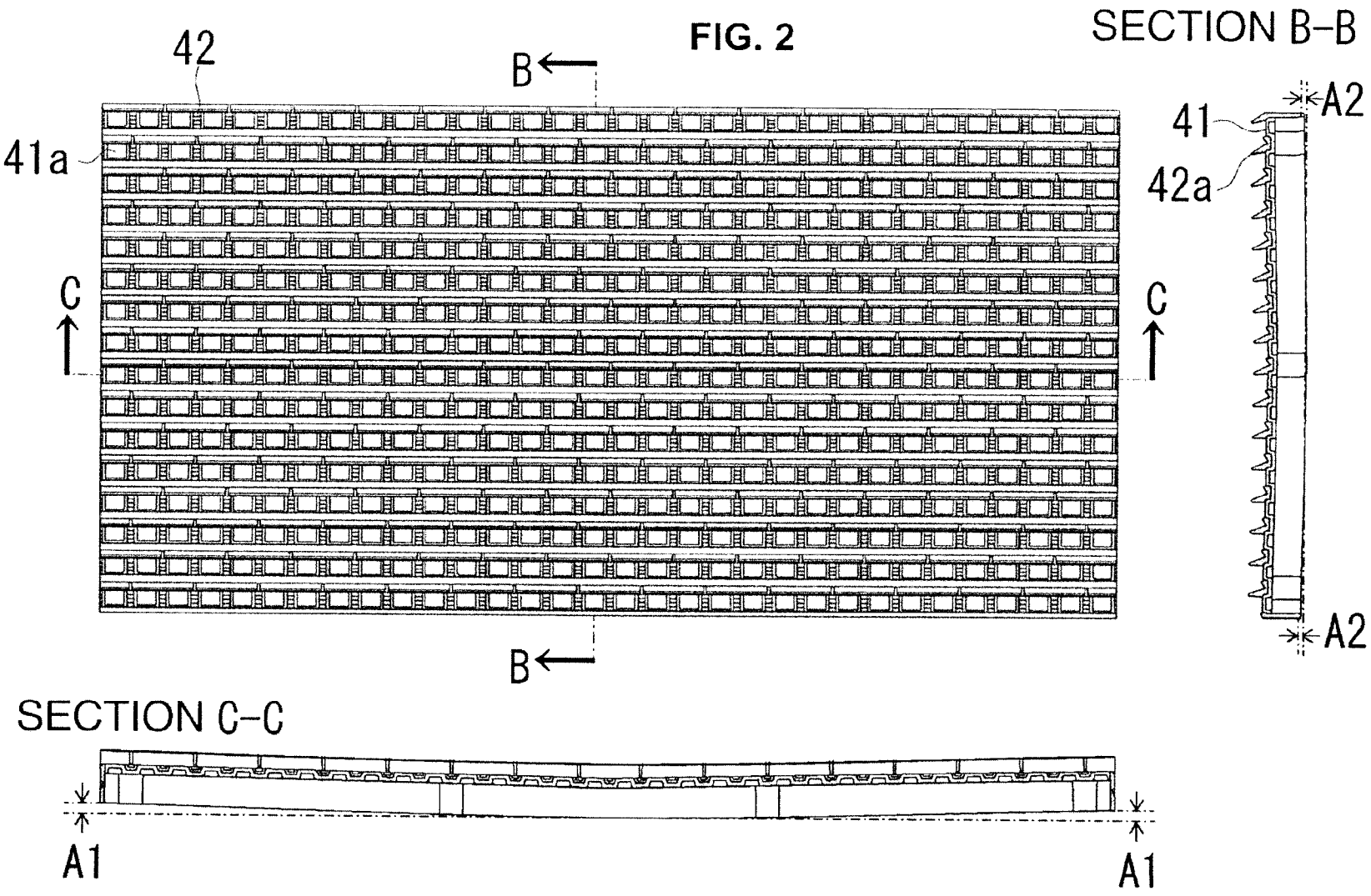
FIG. 2 is a schematic view of a light shielding mask according to certain embodiments.

FIG. 2 is a schematic view of a light shielding mask according to certain embodiments.

As shown in FIG. 2, the light shielding mask 40 has warping A1 in a longitudinal direction and warping A2 in a transversal direction. As described earlier, the deflection of the light shielding mask 40 that is generated when the light shielding mask 40 is screwed to the case 10 is offset by the warping. Incidentally, for example, the warping A1 is 1.5 mm to 3.0 mm and the warping A2 is 0.5 mm to 1.5 mm.

A mode of warping is not particularly limited. For example, the light shielding mask 40 can be warped so as to form a smoothly curved surface as shown in FIG. 2.

As shown in FIG. 2, for example, the light shielding mask 40 may be formed by two-color molding using a light-transmissive member 41 constituting a window 41*a* and a light shielding member 42 that shields external light. Accordingly, the light shielding mask 40 with desired warping can be fabricated in a stable manner. Polycarbonate resin, noryl resin, or the like can be used for the light-transmissive member 41. In addition, polycarbonate resin, noryl resin, or the like can be used for the light shielding member 42. However, a black pigment may be added to the light shielding member 42.

As shown in FIG. 2, a plurality of eaves 42*a* may be provided on the light shielding mask 40. Accordingly, external light (for example, sunlight and illuminating light) can be shielded in an effective manner. When the plurality of windows 41*a* are provided in a matrix pattern, the plurality of eaves 42*a* are respectively linearly provided in one line direction and are separated from one another by prescribed intervals above the windows 41*a*. In other words, the eaves 42*a* are configured so as to be notched at a plurality of locations. Accordingly, since the light shielding mask 40 can be more easily bent, the light shielding mask 40 can be readily made parallel or approximately parallel to the substrate 20. Incidentally, the shape of the eaves 42*a* is not particularly limited.

Figure 3A:
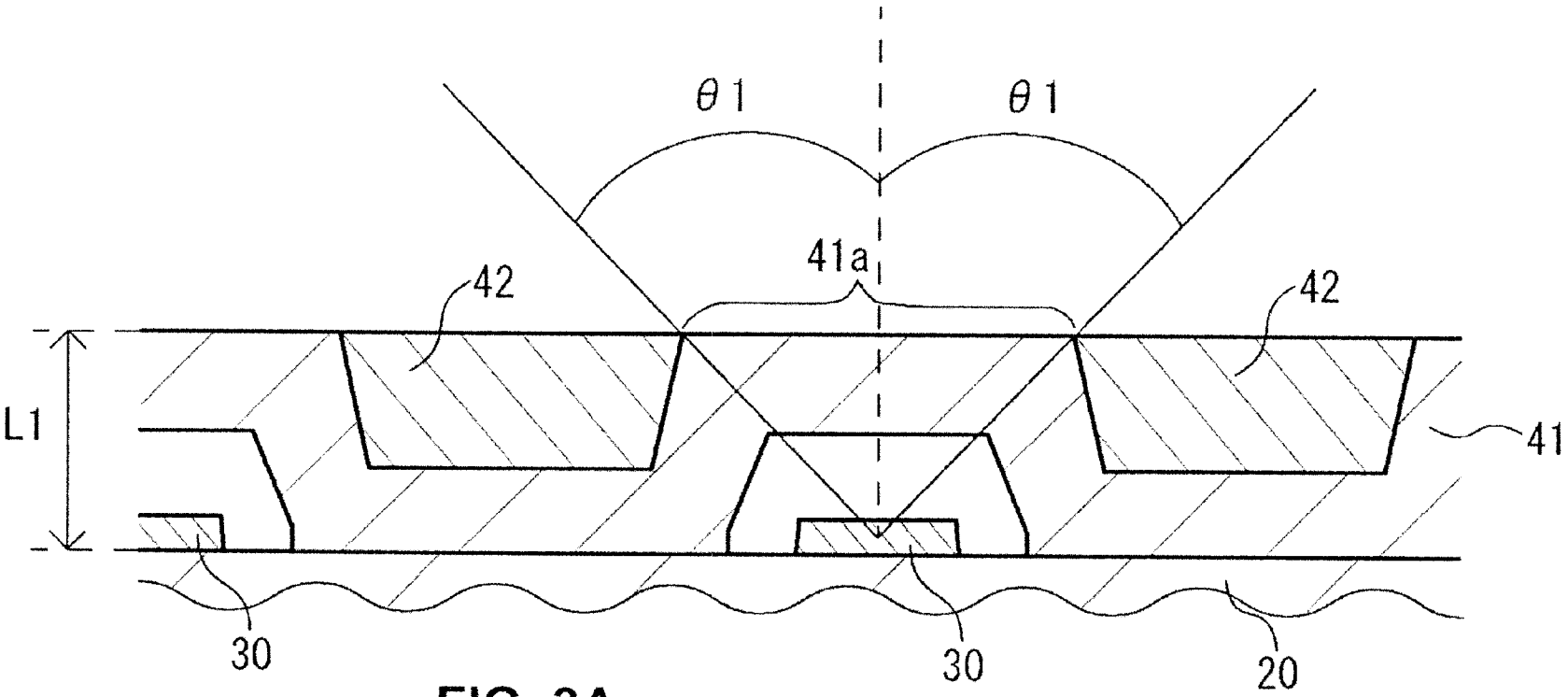
FIG. 3A and FIG. 3B are schematic perspective views illustrating a principle that a viewing angle of a display device is kept wide due to a deflection of a light shielding mask being offset by warping.
Figure 3B:
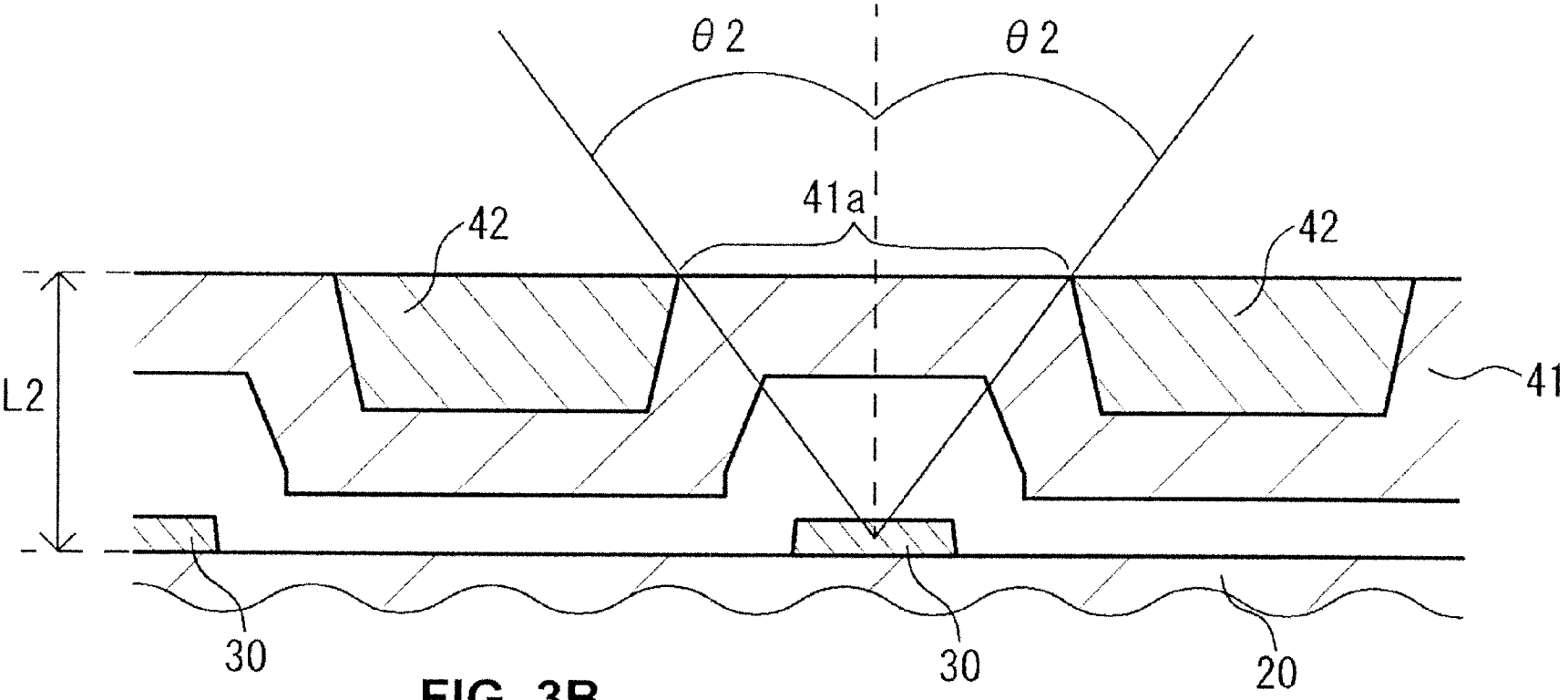

FIG. 3A and FIG. 3B are schematic perspective views illustrating a principle that a viewing angle of a display device is kept wide due to a deflection of a light shielding mask being offset by warping. FIGS. 3A and 3B both correspond to a central part of an area surrounded by screwed locations, wherein FIG. 3A shows a case where the deflection of the light shielding mask is offset by warping and FIG. 3B shows a case where the deflection of the light shielding mask is not offset by warping. Moreover, in FIG. 3A and FIG. 3B, descriptions of components not required to explain the principle have been omitted.

As shown in FIG. 3A, when the deflection is offset by warping due to the light shielding mask 40 (41, 42) being parallel to or approximately parallel to the substrate 20, since the window 41*a* of the light shielding mask 40 (41, 42) approaches the substrate (distance between the window 41*a* of the light shielding mask 40 (41, 42) and the substrate 20: L1), light emitted by the light emitting element 30 at an emission angle that is equal to or smaller than θ1 can be transmitted through the window 41*a* of the light shielding mask 40 (41, 42).

In comparison, as shown in FIG. 3B, when the deflection of the light shielding mask 40 (41, 42) is not offset by warping, the window 41*a* of the light shielding mask 40 (41, 42) moves away from the substrate 20 (distance between the window 41*a* of the light shielding mask 40 (41, 42) and the substrate 20: L2>L1), light emitted by the light emitting element 30 cannot be transmitted through the window 41*a* of the light shielding mask 40 (41, 42) unless the light is emitted at an emission angle that is equal to or smaller than θ2 (θ2<θ1). As a result, the viewing angle of the display device becomes narrower.

As described above, when the deflection of the light shielding mask 40 (41, 42) is offset by warping, light emitted at an emission angle θ (θ2<θ≤θ1) that cannot be transmitted through the window 41*a* of the light shielding mask 40 (41, 42) when the deflection of the light shielding mask 40 (41, 42) is not offset by warping can be transmitted through the window 41*a* of the light shielding mask 40 (41, 42). Therefore, the viewing angle of the display device can be kept wide.

Figure 4A:
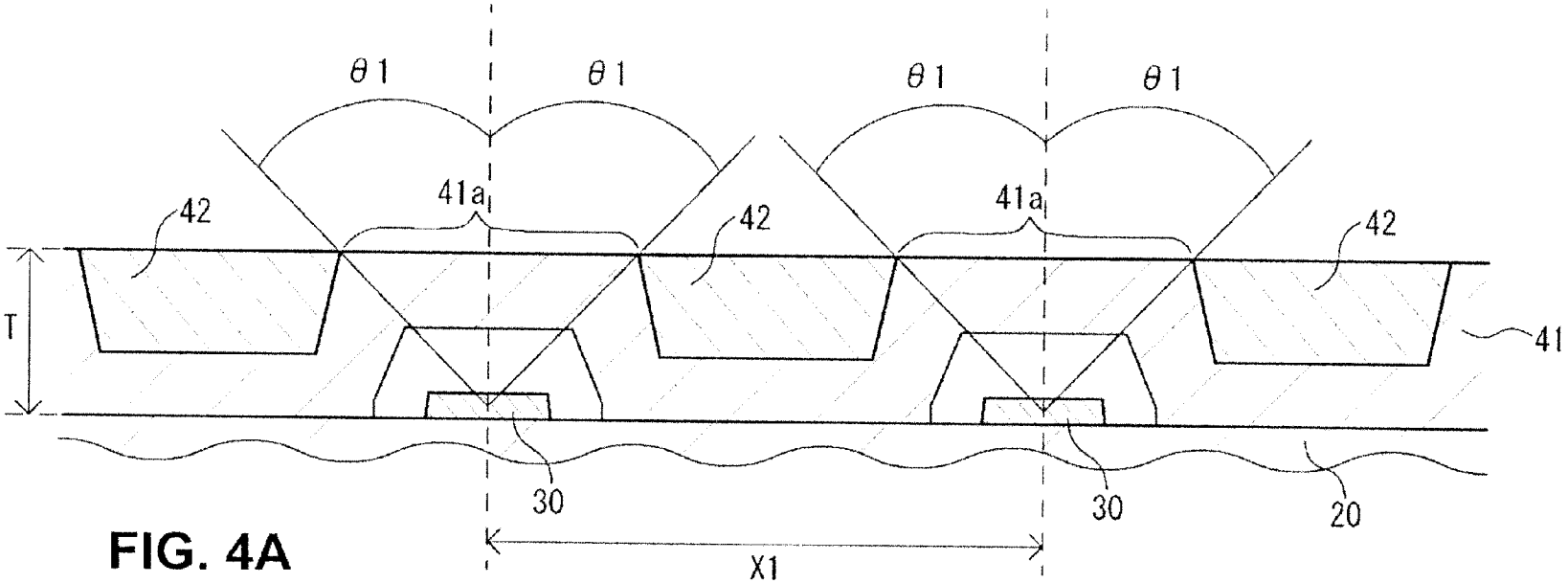
Figure 4B:
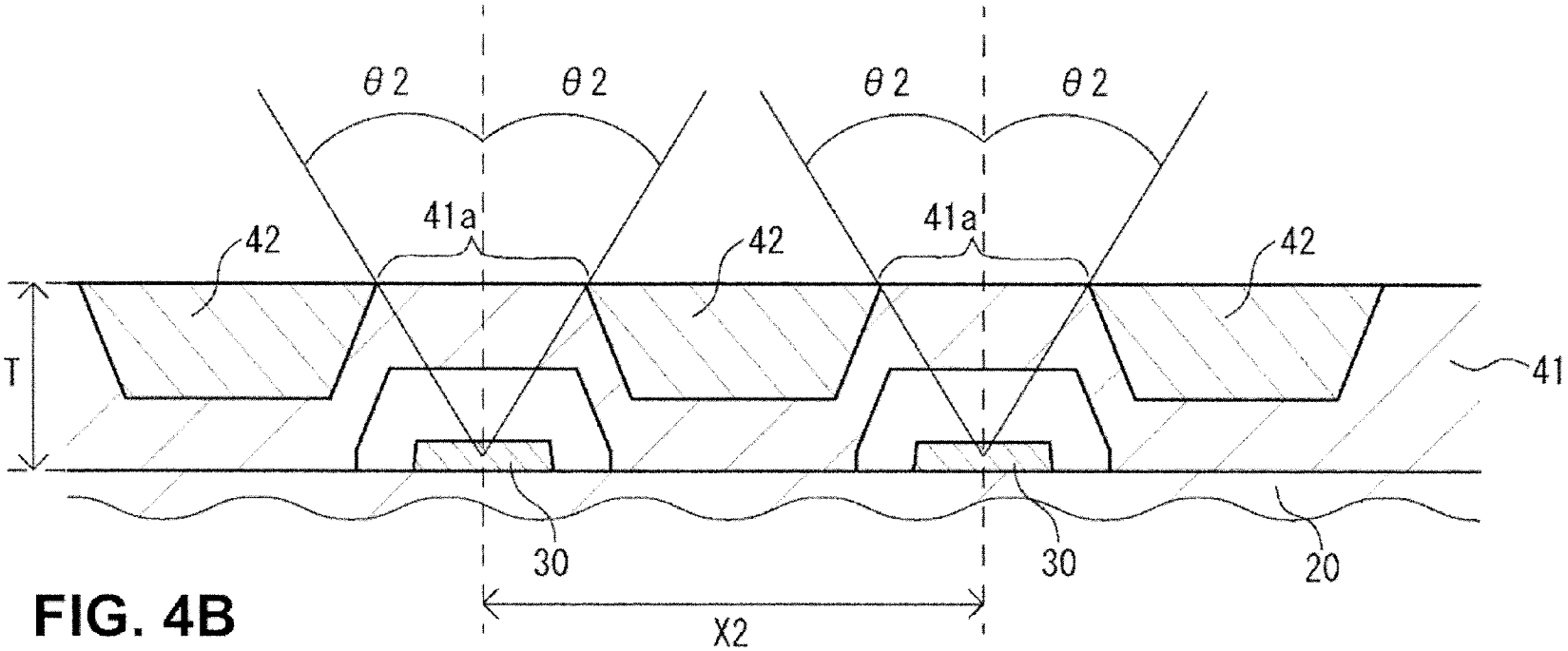

FIG. 4A and FIG. 4B are schematic perspective views illustrating that the embodiments are particularly effective when intervals among a plurality of light emitting elements are small, wherein FIG. 4A shows a case where the intervals is large and FIG. 4B shows a case where the intervals are small. Incidentally, in FIG. 4, descriptions of components not required to explain the principle have been omitted. In this case, an interval between light emitting elements refers to a distance between centers of two adjacent light emitting elements.

As shown in FIG. 4A, when intervals X1 among the plurality of light emitting elements 30 are large, an area of the window 41*a* of the light shielding mask 40 (41, 42) can be increased. Therefore, even if a deflection (a vertical separation of the light shielding mask 40 (41, 42) from the substrate 20) occurs, at least the viewing angle θ1 can be secured.

In comparison, as shown in FIG. 4B, when intervals X2 (X2<X1) among the plurality of light emitting elements 30 are small, the area of the window 41*a* of the light shielding mask 40 (41, 42) must also be reduced. Therefore, the viewing angle θ2 (θ2<θ1) becomes considerably narrower than in a case where a deflection comparable to that shown in FIG. 4A occurs.

Therefore, embodiments of the invention are particularly effective when the intervals among the plurality of light emitting elements 30 are small. More specifically, according to certain embodiments, a viewing angle can be kept wide even with a high resolution display device in which the plurality of light emitting elements 30 are mounted on the substrate 20 at intervals of, for example, 3 to 20 mm, favorably 3 to 10 mm, and more favorably 4 to 8 mm.

Incidentally, while certain embodiments are particularly effective when the intervals among the plurality of light emitting elements 30 are small as described above, the embodiment is also particularly effective when the light shielding mask 40 (41, 42) is thin. This is because a deflection of the light shielding mask 40 (41, 42), in general, is more likely to occur when the thickness (the distance between the window 41*a* of the light shielding mask 40 (41, 42) and the substrate 20: T) decreases. A viewing angle can be kept wide even with a display device in which the light shielding mask 40 (41, 42) is formed with a thickness of, for example, 1 to 5 mm and favorably 1.5 to 3 mm.

Next, a display device according to a first example will be described. The display device according to the first example is an example of the display device according to certain embodiments.

First, a substrate 20 on which a plurality of light emitting elements 30 is mounted is prepared. Surface-mounted LEDs are used as a plurality of light emitting elements 30, for example. The substrate 20 measures 93 mm in longitudinal length, 189.2 mm in transversal length, and 1.6 mm in thickness, and each light emitting element 30 measures 1.8 mm in longitudinal length, 1.8 mm in transversal length, and 0.845 mm in thickness. The plurality of light emitting elements 30 are arranged at 6 mm intervals in a 16 (longitudinal) by 32 (transversal) matrix pattern.

Next, a light shielding mask 40 which is provided with windows 41*a* that transmit light from the plurality of light emitting elements 30 mounted on the substrate 20 and which is warped so as to protrude towards an incident side of light from the light emitting elements 30 is prepared. In this case, the light shielding mask 40 measures 95.5 mm in longitudinal length, 191.5 mm in transversal length, and 1.8 mm in thickness, and the window 41*a* measures 3.6 mm in longitudinal length and 4.2 mm in transversal length. The windows 41*a* are arranged at 6 mm intervals in a 16 (longitudinal) by 32 (transversal) matrix pattern.

The light shielding mask 40 is formed by two-color molding using a light-transmissive polycarbonate resin (a light-transmissive member 41) and a light-shielding polycarbonate resin (a light shielding member 42) including a black pigment and, by adjusting injection conditions, the light shielding mask 40 is provided with warping so as to protrude towards an incident side of light from the light emitting elements 30. Specifically, as seen from the front side, a center of a front surface of the light shielding mask 40 is depressed by 2.0 mm with respect to a peripheral edge as a warping, for example.

Next, a case 10 to which the substrate 20 is disposed and iron screws 50 are prepared.

The light shielding mask 40 is then screwed to the case 10 using the screws 50 so as to be parallel to the substrate 20. As shown in FIG. 1C, screws are used at 12 locations. As described above, the light shielding mask 40 is provided with warping so as to protrude towards an incident side of light from the light emitting elements 30. The deflection of the light shielding mask 40 which is generated by screwing is offset by the warping and the viewing angle of the display device according to the first example is kept wide.

Figure 5A:
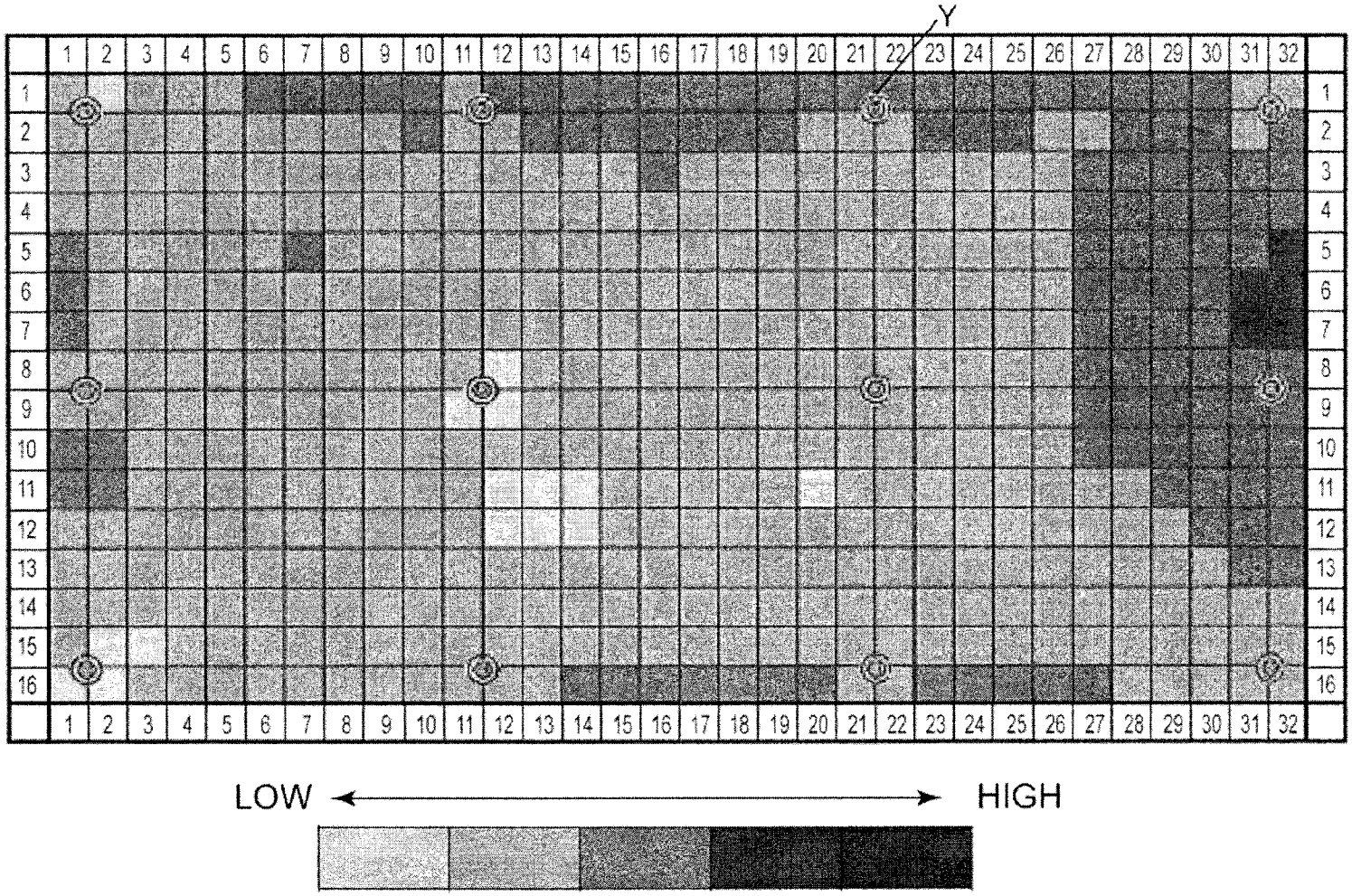
FIG. 5A and FIG. 5B are front views (views of display devices as seen from light shielding masks) comparing a display device of FIG. 5A according to a first example with a display device of FIG. 5B according to a comparative example.
Figure 5B:
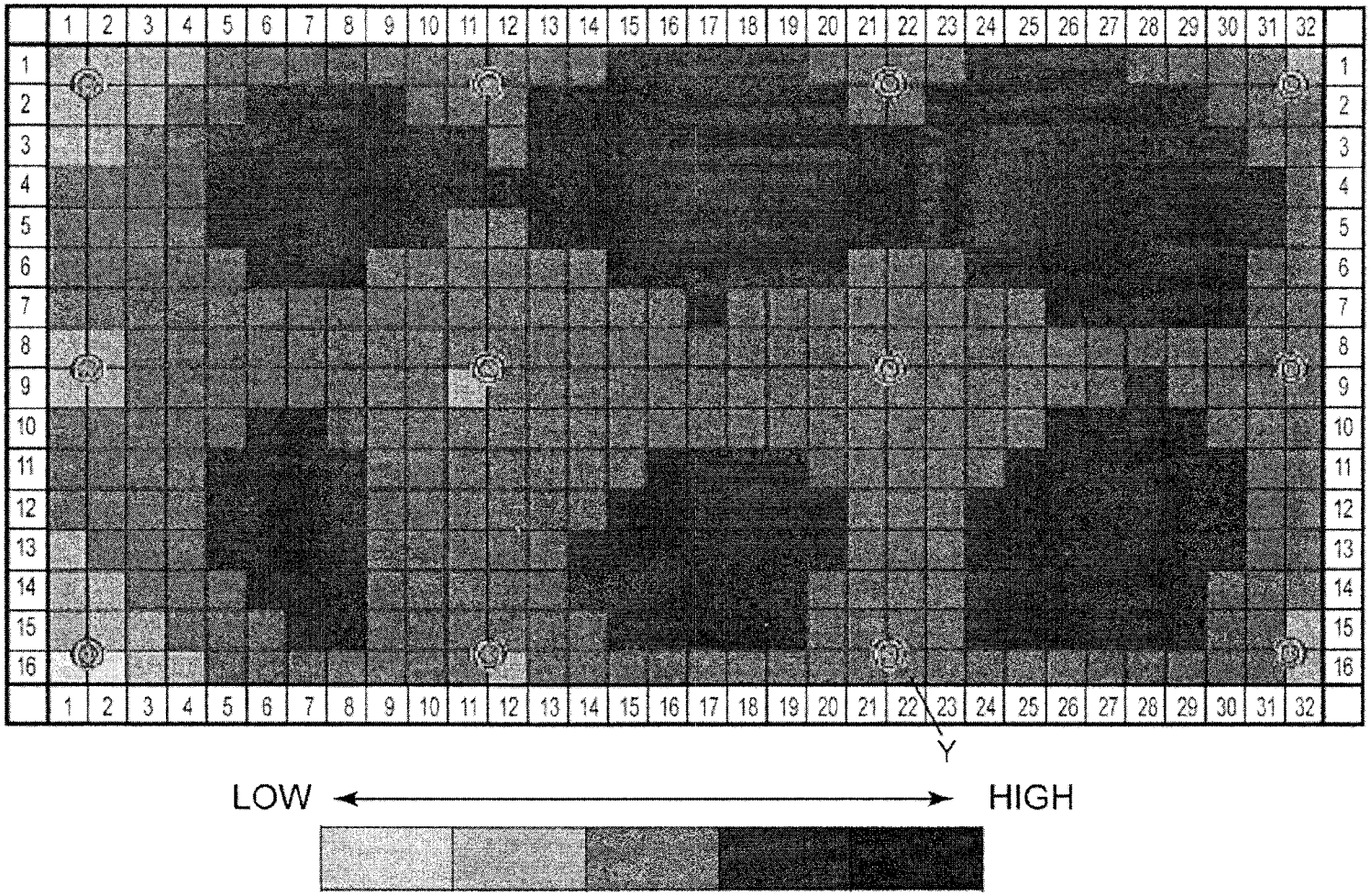

FIG. 5A and FIG. 5B are front views (views of a display device as seen from the light shielding mask) comparing the display device of FIG. 5A according to the first example with a display device of FIG. 5B according to a comparative example. For the display device according to the comparative example, a display device sharing the same configuration as the display device according to the first example is used with the exception of using a light shielding mask that is not warped. Incidentally, FIG. 5A and FIG. 5B are diagrams representing measurement results of heights of upper surfaces of the light shielding masks by a three-dimensional measuring machine and show the height of the light shielding mask 40 in shades of color, wherein the darker the color, the greater the height. In other words, the darker the color, the greater the distance between the light shielding mask 40 and the substrate 20.

As shown in FIG. 5A, with the display device according to the first example, since the light shielding mask 40 is warped, the distance between the light shielding mask 40 and the substrate 20 is relatively small when the light shielding mask 40 is screwed to the case 10.

On the other hand, as shown in FIG. 5B, with the display device according to the comparative example, since the light shielding mask 40 is not warped, the distance between the light shielding mask 40 and the substrate 20 is relatively large when the light shielding mask 40 is screwed to the case 10.

Therefore, it can be seen that the display device according to the first example is more capable of maintaining a wide viewing angle than the display device according to the comparative example.

Y in FIG. 5 represents a screwed location.

Figure 6A:
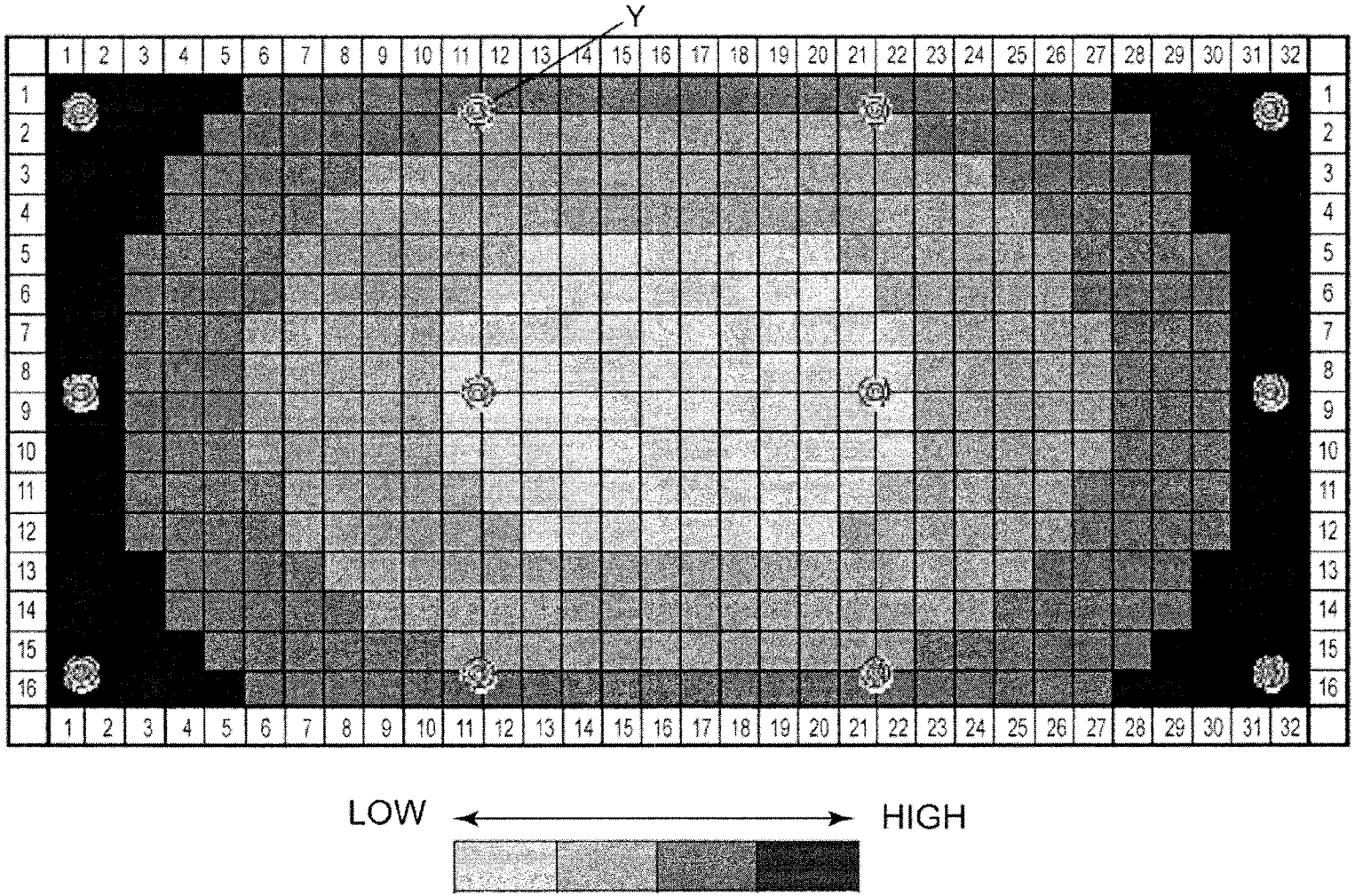
Figure 6B:
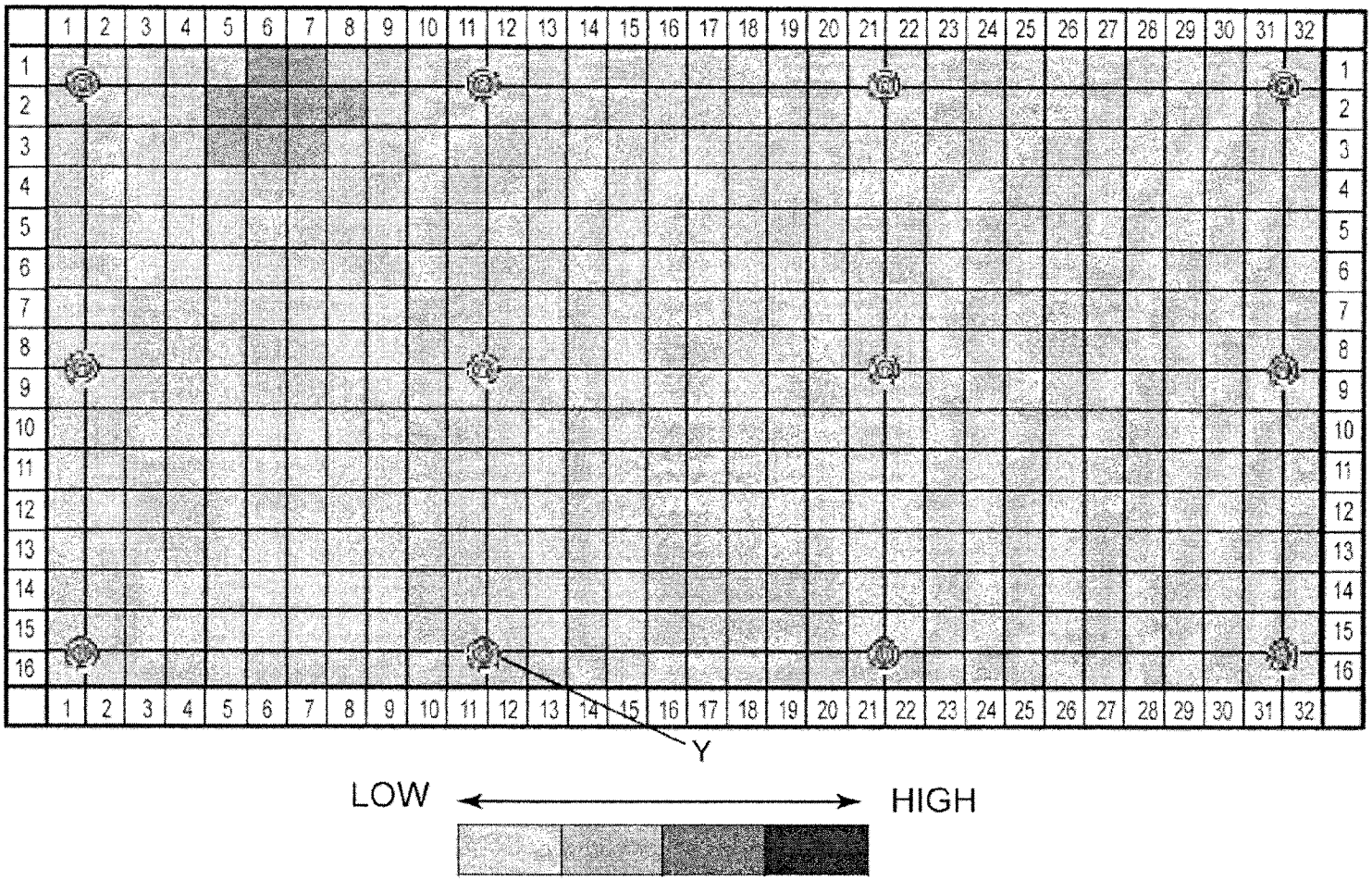

Each of FIG. 6A and FIG. 6B is a front view of a light shielding louver prior to being screwed to a substrate, wherein FIG. 6A is a front view of a light shielding louver used in the display device according to the first example and FIG. 6B is a front view of a light shielding louver used in the display device according to the comparative example. In a similar manner to FIG. 5, FIG. 6 is a diagram representing measurement of a height of an upper surface of the light shielding mask as measured by a three-dimensional measuring machine and shows the height of the light shielding mask 40 in shades of color, wherein the darker the color, the greater the height. In other words, the darker the color, the greater the distance between the light shielding mask 40 and the substrate 20.

As shown in FIG. 6A, the light shielding mask 40 used in the display device according to the first example is configured so as to form a curved surface from a center to a peripheral edge prior to being screwed to the substrate 20 and is warped so as to protrude towards an incident side of light from the plurality of light emitting elements 30. As described earlier, the warping is offset by the deflection of the light shielding mask 40 that is generated upon screwing.

On the other hand, as shown in FIG. 6B, the light shielding mask used by the display device according to the comparative example is not warped prior to being screwed to the substrate. Therefore, the deflection of the light shielding mask 40 that is generated upon screwing is not offset by warping and is retained by the light shielding mask 40.

Y in FIG. 6 represents a screwing location.

While embodiments and examples have been described above, the description merely represents examples and is not intended to limit the present invention in any way whatsoever.

10 case
20 substrate
30 light emitting element
40 light shielding mask
41 light-transmissive member
41*a* window
42 light shielding member
42*a* eaves
50 screw
60 bracket
70 first packing
80 second packing
T thickness
L1, L2 distance between window of light shielding mask and substrate
A1, A2 warping
X1, X2 interval
Y screwed location or screwing location

What is claimed is:

1. A display device manufacturing method, said method comprising:

preparing a substrate on which a plurality of light emitting elements are mounted;

preparing a light shielding mask that is provided with a plurality of windows respectively transmitting light from the plurality of light emitting elements and that is warped so as to protrude towards an incident side of light from the plurality of light emitting elements, wherein the light shielding mask has a warping in a longitudinal direction and the light shielding mask also has a warping in a transversal direction;

preparing a case in which a substrate is disposed; and screwing the light shielding mask to the case at screwing locations in a left side area, a right side area, an upper side area, a lower side area, and a central area, so that the light shielding mask is parallel or approximately parallel with respect to the substrate, wherein a first packing is interposed between the case and the light shielding mask.

2. The display device manufacturing method according to claim 1, wherein the preparing the light shielding mask includes preparing the light shielding mask in which a plurality of windows that respectively transmit light from the plurality of light emitting elements are provided in a matrix pattern, the light shielding mask including a plurality of eaves that are in one line direction and that are separated from one another above the windows, and the light shielding mask being warped so as to protrude towards an incident side of light from the plurality of light emitting elements.

3. The display device manufacturing method according to claim 1, wherein the preparing the substrate includes preparing the substrate on which the plurality of light emitting elements are mounted at intervals of 3 to 20 mm.

4. The display device manufacturing method according to claim 1, wherein the preparing the light shielding mask includes forming the light shielding mask by two-color molding using a light-transmissive member constituting the windows and a light shielding member that shields light.

5. The display device manufacturing method according to claim 1, wherein the preparing the light shielding mask includes preparing the light shielding mask which is warped so that a center of the light shielding mask protrudes toward the substrate.

6. The display device manufacturing method according to claim 5, wherein the preparing the substrate includes preparing the substrate on which the plurality of light emitting elements are mounted at intervals of 3 to 20 mm.

7. The display device manufacturing method according to claim 5, wherein the preparing the light shielding mask includes forming the light shielding mask by two-color molding using a light-transmissive member constituting the windows and a light shielding member that shields light.

8. The display device manufacturing method according to claim 5, wherein the preparing the light shielding mask includes preparing the light shielding mask which is warped by 1.5 mm or more and 3.0 mm or less in the longitudinal direction.

9. The display device manufacturing method according to claim 8, wherein the preparing the light shielding mask includes preparing the light shielding mask which is warped by 0.5 mm or more and 1.5 mm or less in the transversal direction.

10. The display device manufacturing method according to claim 5, wherein the preparing the light shielding mask includes preparing the light shielding mask which is warped by 0.5 mm or more and 1.5 mm or less in the transversal direction.

11. The display device manufacturing method according to claim 5, wherein the preparing the light shielding mask includes preparing the light shielding mask which has a thickness of 1 to 5 mm.

12. The display device manufacturing method according to claim 1, wherein the preparing the light shielding mask includes preparing the light shielding mask which is warped by 1.5 mm or more and 3.0 mm or less in the longitudinal direction.

13. The display device manufacturing method according to claim 12, wherein the preparing the light shielding mask includes preparing the light shielding mask which is warped by 0.5 mm or more and 1.5 mm or less in the transversal direction.

14. The display device manufacturing method according to claim 1, wherein the preparing the light shielding mask includes preparing the light shielding mask which is warped by 0.5 mm or more and 1.5 mm or less in the transversal direction.

15. The display device manufacturing method according to claim 1, wherein the preparing the light shielding mask includes preparing the light shielding mask which has a thickness of 1 to 5 mm.

16. The display device manufacturing method according to claim 2, wherein the preparing the substrate includes preparing the substrate on which the plurality of light emitting elements are mounted at intervals of 3 to 20 mm.

17. The display device manufacturing method according to claim 2, wherein the preparing the light shielding mask includes forming the light shielding mask by two-color molding using a light-transmissive member constituting the windows and a light shielding member that shields light.

18. The display device manufacturing method according to claim 2, wherein the preparing the light shielding mask includes preparing the light shielding mask which is warped so that a center of the light shielding mask protrudes toward the substrate.

19. The display device manufacturing method according to claim 2, wherein the preparing the light shielding mask includes preparing the light shielding mask which is warped by 1.5 mm or more and 3.0 mm or less in the longitudinal direction.

20. The display device manufacturing method according to claim 19, wherein the preparing the light shielding mask includes preparing the light shielding mask which is warped by 0.5 mm or more and 1.5 mm or less in the transversal direction.

21. The display device manufacturing method according to claim 2, wherein the preparing the light shielding mask includes preparing the light shielding mask which is warped by 0.5 mm or more and 1.5 mm or less in the transversal direction.

22. The display device manufacturing method according to claim 2, wherein the preparing the light shielding mask includes preparing the light shielding mask which has a thickness of 1 to 5 mm.

23. A display device manufacturing method, said method comprising:

preparing a substrate on which a plurality of light emitting elements are mounted;

preparing a light shielding mask that is provided with a plurality of windows respectively transmitting light from the plurality of light emitting elements and that is warped so as to protrude towards an incident side of light from the plurality of light emitting elements;

preparing a case in which a substrate is disposed; and screwing the light shielding mask to the case at a screwing location in a central area of the light shielding mask, so that the light shielding mask is parallel or approximately parallel with respect to the substrate, wherein a first packing is interposed between the case and the light shielding mask.

* * * * *